US008403039B2

(12) United States Patent
Howell et al.

(10) Patent No.: US 8,403,039 B2
(45) Date of Patent: Mar. 26, 2013

(54) TOOL AND METHOD FOR PROVIDING ACCESS TO A WELLHEAD ANNULUS

(75) Inventors: James J. Howell, Bryan, TX (US); David Daniel Comeaux, Houston, TX (US); Richard Porteous, Ellon (GB); Mariusz Karp, Kryg (PL)

(73) Assignee: Vetco Gray Inc., Houston, TX (US)

( * ) Notice: Subject to any disclaimer, the term of this patent is extended or adjusted under 35 U.S.C. 154(b) by 289 days.

(21) Appl. No.: 12/779,468

(22) Filed: May 13, 2010

(65) Prior Publication Data

US 2011/0278007 A1 Nov. 17, 2011

(51) Int. Cl.
*E21B 33/03* (2006.01)

(52) U.S. Cl. ..... 166/242.5; 166/77.1; 166/88.4; 137/318; 137/322

(58) Field of Classification Search ..... 166/88.4, 166/90.1, 77.1, 77.2, 242.5, 277; 137/318, 137/322
See application file for complete search history.

(56) References Cited

U.S. PATENT DOCUMENTS

| | | | | |
|---|---|---|---|---|
| 3,703,909 | A * | 11/1972 | Erb | 137/318 |
| 3,827,448 | A * | 8/1974 | Alba | 137/15.11 |
| 4,972,904 | A | 11/1990 | Godare | |
| 5,027,903 | A | 7/1991 | Gipson | |
| 5,927,405 | A | 7/1999 | Monjure et al. | |
| 6,186,239 | B1 | 2/2001 | Monjure et al. | |
| 6,200,068 | B1 | 3/2001 | Bath et al. | |
| 6,289,992 | B1 | 9/2001 | Monjure et al. | |
| 6,315,046 | B1 | 11/2001 | Jack et al. | |
| 6,929,244 | B1 | 8/2005 | Law et al. | |
| 7,069,995 | B2 | 7/2006 | Chan et al. | |
| 7,309,058 | B2 | 12/2007 | Hunter et al. | |
| 7,686,091 | B2 | 3/2010 | Jennings et al. | |
| 2003/0111229 | A1 | 6/2003 | Clark | |
| 2011/0290507 | A1 * | 12/2011 | Stewart et al. | 166/385 |

FOREIGN PATENT DOCUMENTS

| | | | |
|---|---|---|---|
| GB | 2333307 | A | 7/1999 |
| WO | WO 98/57028 | A1 | 12/1998 |

OTHER PUBLICATIONS

File history of co-pending U.S. Appl. No. 12/469,489, filed May 20, 2009.
Search Report from corresponding GB Application No. GB1107685.8 dated Jul. 5, 2011.

* cited by examiner

*Primary Examiner* — William P Neuder
*Assistant Examiner* — Richard Alker
(74) *Attorney, Agent, or Firm* — Bracewell & Giuliani LLP

(57) ABSTRACT

A system and method for accessing an annulus within a wellhead assembly while the annulus is pressurized. The system includes a tubular body with an attached valve assembly and adapter. The adapter to the wellhead assembly with a sealed annular fitting. The body houses a selectively extendable plunger assembly rotatable by an attached motor. A bit or milling device is provided on the end of the plunger assembly, so that selectively extending the plunger assembly through the valve assembly and adapter contacts the bit against the wellhead assembly. An opening is formed through the wellhead assembly with the rotating bit allowing access to the annulus.

21 Claims, 8 Drawing Sheets

TOOL AND METHOD FOR PROVIDING ACCESS TO A WELLHEAD ANNULUS

FIELD OF THE INVENTION

This invention relates in general to production of oil and gas wells, and in particular to a tool and method for accessing an annulus within a wellhead assembly. More specifically, the tool and method disclosed herein can create an access port, while maintaining the well at pressure, through a wellhead housing to an annulus within the housing.

DESCRIPTION OF RELATED ART

Hydrocarbon producing wellbores have casing lining the wellbore and production tubing suspended within the casing. Some wellbores may employ multiple well casings of different diameters concentrically arranged in the wellbore thereby forming at least one annulus between the tubulars. In some instances, well maintenance may require access to an annulus. For example, a casing string may develop a leak thereby pressurizing an annulus between the leaking casing string and adjacent casing. Other sources of leaks include tubing, packers, wellhead packoffs, and faulty casing cement bond.

Pressure in the annulus can be controlled by introducing a high specific gravity fluid into the annulus, thereby isolating the wellhead from the pressure. In addition to adding fluid directly to the top of the annulus through a wellhead, hydraulic hose systems have been used to inject fluid into the pressurized annulus. The hose generally includes a nozzle element lowered proximate to the annulus bottom where the fluid is discharged from the hose. However not all wellhead assemblies include access to a wellhead annulus. In these instances the wellhead housing may be bored through to form an access port. Since currently known methods of boring do not "hot tap", i.e. form the bore while the annulus is pressurized, the annulus must be vented to atmosphere before creating the access port.

Shown in a side sectional view in FIG. 1 is a prior art example of a wellhead assembly 10. The assembly 10 includes an annular conductor pipe 12 that circumscribes the upper portion of a wellbore (not shown). Attached around the upper portion of the conductor pipe 12 is a low pressure housing 14. Casing 16 is inserted within the wellhead assembly 10 that depends downward within the conductor pipe 12. A compressive lock ring 17 is illustrated within the housing 14 for locking together members of the wellhead assembly 10. The space between the casing 16 and wellhead housing 14 and conductor pipe 12 defines a casing annulus 18. A flange 19 is bolted to a side of the wellhead housing 14 for attachment of a flow line 20. A wing valve 21 regulates fluid flow through the flow line 20. A port 22 is formed through the wellhead, housing 14 allowing pressure communication between the annulus 18 and flow line 20. The perpendicular orientation of the port 22 and annulus 18 does not significantly affect fluid flow between the annulus 18 and flow line 20. However the annulus 18 and port 22 arrangement can impede hardware access to the annulus 18 from external to the wellhead housing 14. In one known manner of enabling hardware access to the annulus 18, the flange 19 is unbolted from the wellhead assembly 10, after depressurizing the annulus 18, and a handheld device is used to drill through the wellhead housing 14 at an angle oblique to the port 22.

SUMMARY OF INVENTION

Disclosed herein is a method of providing an access path to an annulus in a wellhead assembly; in one example the method includes providing an apparatus with a housing, a selectively extendable and selectively rotatable plunger assembly, and a boring element on an end of the plunger assembly. An end of the housing is sealingly connected to an outer surface of the wellhead assembly, and the boring element is rotated by rotating the plunger assembly, and then boring an opening through the wellhead assembly by extending the plunger assembly in a direction along the housing and rotatingly contacting the wellhead assembly with the boring element to thereby provide pressure communication between the annulus and the housing. The method may further include retracting the boring element from the wellhead assembly and accessing the annulus through the opening. The boring element can be retracted from the wellhead assembly by providing a seal between the boring element and the wellhead assembly, replacing the plunger assembly with an annulus remediation system having an elongate flexible member, removing the seal, and inserting an end of the flexible member through the opening and into the annulus. The apparatus can further include a motor having a drive shaft coupled to the plunger assembly, so that operating the motor rotates the plunger assembly. Extending the plunger assembly in a direction along the housing may be done by introducing pressurized fluid into the plunger assembly. In one example, the plunger assembly is made up of a mandrel, a sliding sleeve circumscribing the mandrel, a plenum between the mandrel and the housing, a fluid fitting radially coupled in the housing in fluid communication with the plenum, an axial bore in the mandrel, and bore inlets formed through the mandrel between the plenum and axial bore, so flowing pressurized fluid from the fluid fitting, through the plenum, bore inlets, and axial bore, directs the fluid into the sleeve from the axial bore. The apparatus can further have a passage axially provided in the housing, and the method can also include selectively sealing the passage between the wellhead housing and the mandrel. The apparatus may further optionally have an annular space between the sleeve and the housing and an annular piston attached to the sleeve outer periphery that extends into sealing contact with the housing inner surface; the method can further include moving the boring element away from the wellhead assembly by providing pressurized fluid into the annular space on the side of the piston facing the wellhead assembly. The method may further involve directing a fluid flow at the boring element as it rotatingly contacts the wellhead assembly.

Also described herein is an apparatus for providing access to an annulus within a wellhead assembly. In one example the apparatus include a tubular body, a selectively extendable and selectively rotatable plunger assembly disposed in the body, a rotating drive source coupled to the plunger assembly, an open end on the body sealingly connectable to the wellhead assembly, and a boring element on an end of the plunger assembly facing the body open end, so that when the plunger assembly is extended and rotated, the boring element rotatingly can contact and bore a hole in the wellhead assembly. The body may be disposed at an oblique angle to the wellhead assembly axis, so that when the boring element bores the hole in the wellhead assembly, the hole is directed downward and inward. In one example, the plunger assembly includes a sleeve rotatingly coupled with a mandrel and slidable thereon. A pressurized fluid source can be included with the apparatus that is in communication with a space in the plunger assembly and a motor coupled to the plunger assembly. Boring an opening through the wellhead assembly can provide pressure communication between the annulus and the housing. In one example, the housing has a tubular end portion circumscribing the plunger assembly, a valve body connected to an end of the end portion, and an annular adapter having a side connected to the side of the valve body opposite the end portion and another side comprising the housing open end and connected to the wellhead assembly. A port may be formed through the adapter having an inlet in selective fluid communication with a supply of fluid and a discharge directed towards the wellhead assembly, so that when the boring element is boring an opening through the wellhead assembly, fluid flow from the discharge can cool the boring element and irrigate away particles of the wellhead assembly machined by the boring element. Optionally included are a plenum within the body and circumscribing a portion of the mandrel, an axial bore formed through the mandrel, a port formed through the body adjacent the plenum, a pressurized fluid source in selective communication with the port, bore inlets in the mandrel extending between the plenum and axial bore, and a closed end on the sleeve in pressure communication with the axial bore, so that when pressurized fluid flows into the axial bore a force is applied to the closed end to urge the sleeve away from the mandrel. The apparatus may yet further optionally include a bypass port extending from the axial bore to the mandrel outer surface. The sleeve, in one example, includes an annular portion with an open end in which the mandrel is slidingly received and a solid portion forming the closed end, wherein the boring element is on the end of the sleeve opposite the open end. The apparatus may optionally have an annular piston circumscribing the sleeve outer that extends radially outward into sealing contact with the housing inner circumference and a supply of pressurized fluid selectively in fluid communication on the side of the piston facing the wellhead assembly, so that when pressurized fluid is introduced to the side of the piston facing the wellhead assembly, the sleeve slides coaxially within the housing away from the wellhead assembly and retracts the boring element from within the opening bored through the wellhead assembly.

Also disclosed herein is a wellhead assembly with a wellhead housing, tubulars coaxially depending within the wellhead assembly defining an annulus between the tubulars, a tubular member having an end sealingly attached to an outer portion of a sidewall of the wellhead housing, a passage within the tubular member extending along its axis, a selectively rotatable plunger assembly provided within the passage and having a selectively telescoping end, a boring element on the telescoping end, a pressurized fluid source in selective communication with the plunger assembly, so that when pressurized fluid is supplied to the plunger assembly, the telescoping end is extended to contact the boring element with the wellhead housing, and a motor having a rotatable drive shaft attached to the non-telescoping end of the plunger assembly, so that when the motor activates the rotatable drive shaft and the boring element contacts the wellhead housing, the rotating boring element machines an opening through the wellhead housing. The plunger assembly may include an annular mandrel having an end coupled to the motor drive shaft, an axial bore in the mandrel in selective communication with pressurized fluid, a sleeve rotationally coupled to the mandrel and slideable with respect to the mandrel along the mandrel axis, and a piston surface on the sleeve defined by a wall substantially perpendicular to the sleeve axis. In one example, the sleeve is insertable within the axial bore and the piston surface is on the end of the sleeve within the bore. Optionally, the sleeve includes an annular portion that circumscribes the mandrel, and the piston surface comprises a solid portion of the sleeve adjacent the annular portion.

DETAILED DESCRIPTION OF THE INVENTION

Figure 1:
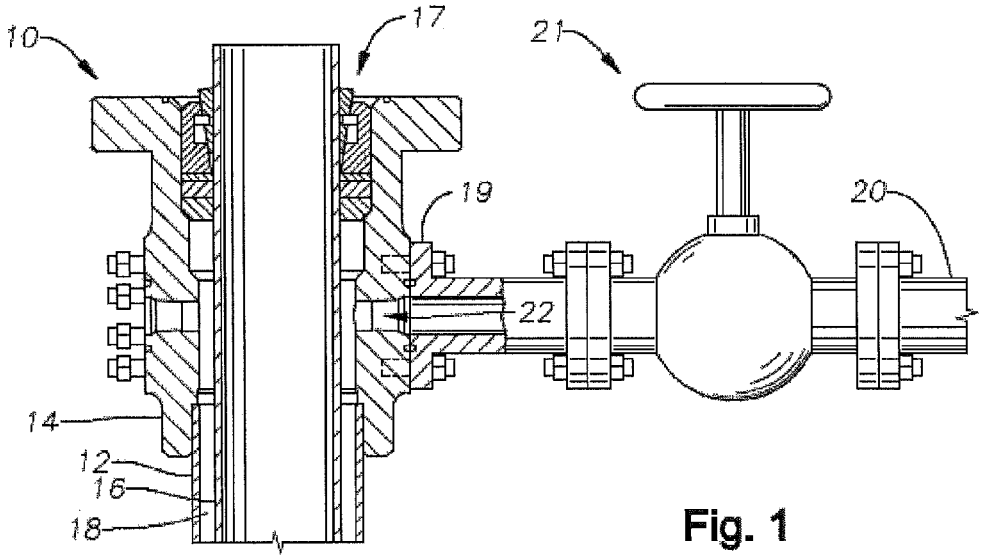
Fig. 1 (Prior Art)
FIG. 1 is a side sectional view of a prior art wellhead assembly.

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

Figure 2:
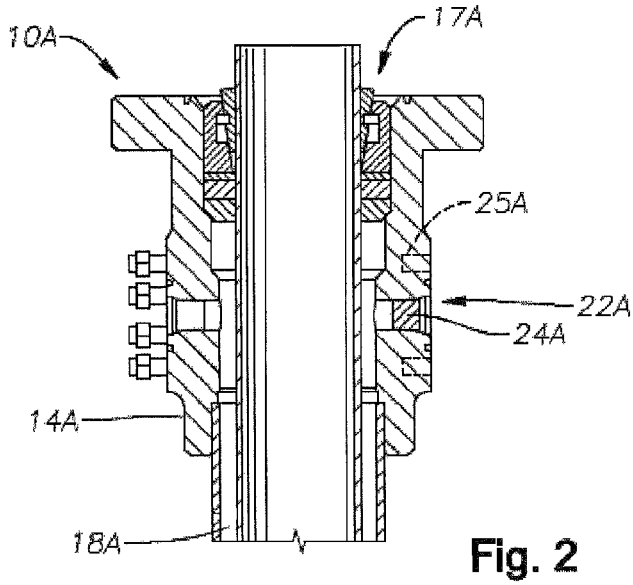
FIG. 2 provides a sectional view of a wellhead assembly having a plugged port.
Figure 3:
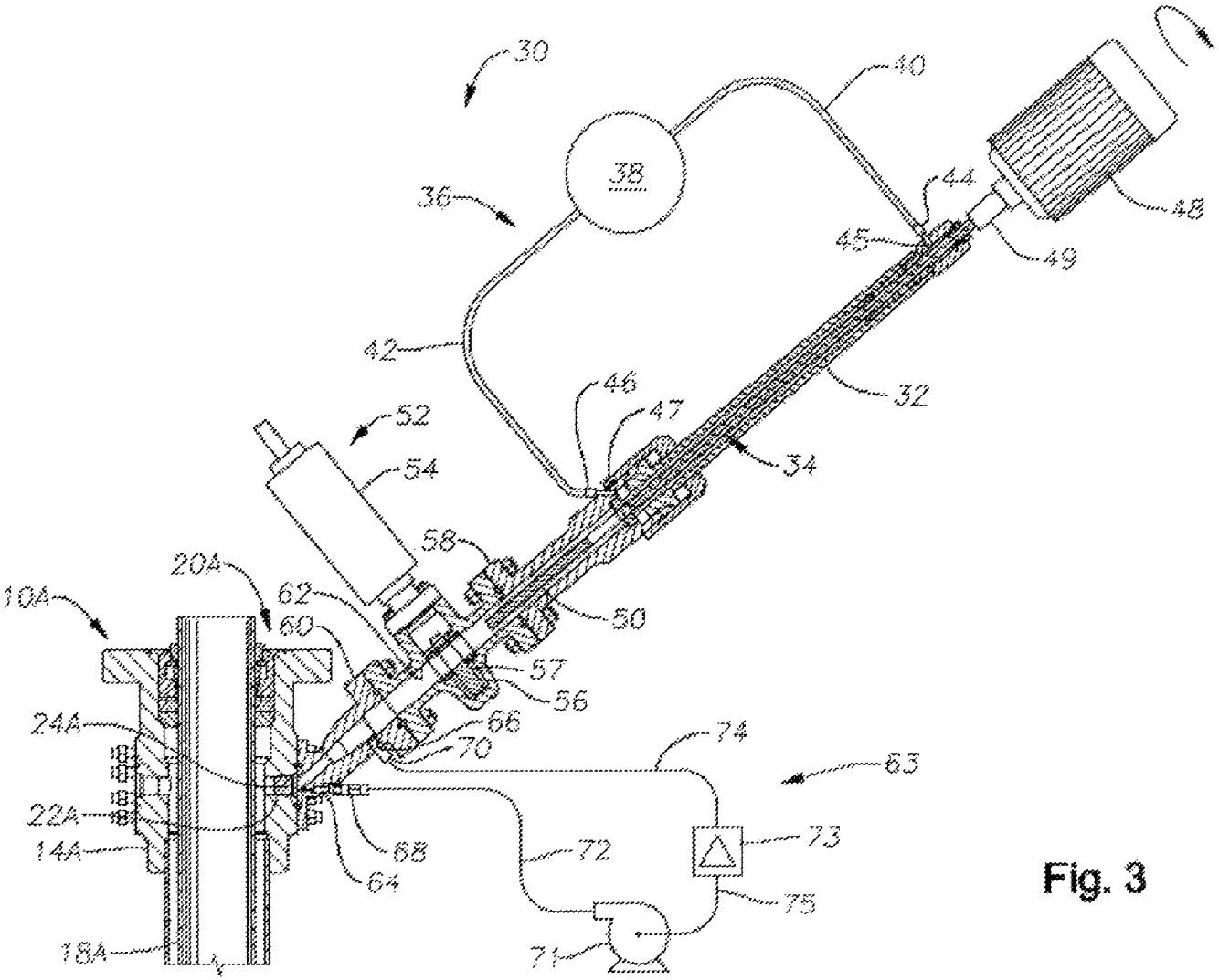
FIG. 3 illustrates a side partial sectional view of an example of a system for accessing an annulus in a wellhead assembly.

Shown in FIG. 2 is a side sectional view of a wellhead assembly 10A having a threaded plug 24A inserted within a port 22A. A tool (not shown) provides a seal in the flow line 20 across which the plug 24A is inserted and tightened within the port 22A to seal the ambient environment from the annulus 18. The valve 21 and flow line 20 can be removed by unbolting the flange 19 from the housing 14A. Boltholes 25A (shown in dashed outline) remain in the housing 14A. Referring now to FIG. 3, an example of a wellhead annulus entry system 30 for accessing a wellhead annulus is illustrated in a side partial sectional view. As shown, the entry system 30 includes an annular body 32 with a coaxially disposed plunger assembly 34. A hydraulic circuit 36 is shown connected at different points along the body 32. The hydraulic circuit 36 includes a schematically illustrated hydraulic fluid supply 38 with connected hydraulic lines 40, 42. The hydraulic lines 40, 42 respectively terminate into hydraulic fittings 44, 46 shown mounted in bores 45, 47 formed through the body 32 housing. A motor 48 is depicted attached to an end of the plunger assembly 34 via a coupling 49. A boring element 50 is shown attached on the end of the plunger assembly 34 opposite the motor 48. In this example, the boring element 50 can be a drill bit, reamer, grinder, or milling device. Boring element 50 is aligned to drill a hole in wellhead housing 14 that may extend downward and inward toward the wellhead housing 14 axis. While forming the hole, the boring element 50 can bore through at least a portion of the radial port 22A (FIG. 2).

A valve assembly 52 is shown flangedly bolted to the end of the housing 32 opposite the motor 48. The valve assembly 52 includes an automatic valve actuator 54 coupled on top of a valve body 56. A gate 57 is shown residing within the lower portion of the valve body 56 and can be actuated by manipulating the valve actuator 54. As shown, the gate 57 is in the open position, thereby allowing passage and pressure communication through the valve assembly 52. A flange 58 on an end of the body 32 bolts to a flange on the valve body 56. An adaptor 60 is shown attached to the valve assembly 52 on the side opposite the body 32. On its side opposite the valve body 56, the adaptor 60 is shown attached onto the outer surface of a conventional wellhead housing 14A of a wellhead assembly 10A. Bolts anchored in boltholes 25A anchor the adaptor 60 to the wellhead housing 14A, other attachment methods include welded, threaded, or interference fittings. The adaptor 60 is shown attached proximate to the port 22A with threadingly inserted threaded plug 24A. Port 22A is on a radial line substantially perpendicular to the housing 14A axis. The annular configuration of the housing 32, valve body 56, and adaptor 60 form a passage 62 that axially extends within the annulus entry system 30.

An optional cleaning fluid circuit 63 is illustrated coupled to a port 64 extending through the adaptor 60 and directed towards the terminal end of the passage 62. As will be described in more detail below, providing fluid flow through this circuit 63 can provide cooling to the boring element 50 and also remove any machined particles that may be produced while operating the boring element 50. An additional port 66 is provided through the adaptor 60 having an end that communicates with the passage 62. Fittings 68, 70 are shown inserted respectively in the ports 64, 66. The cleaning fluid circuit 63 may optionally be driven by a pump 71 shown having a discharge side coupled to line 72 that terminates at fitting 68. For collecting machined cuttings, an optional filter 73 is shown in fluid communication with fitting 70 via line 74. Fluid, once leaving the filter 73, is drawn into pump 71 via suction line 75.

Figure 4:
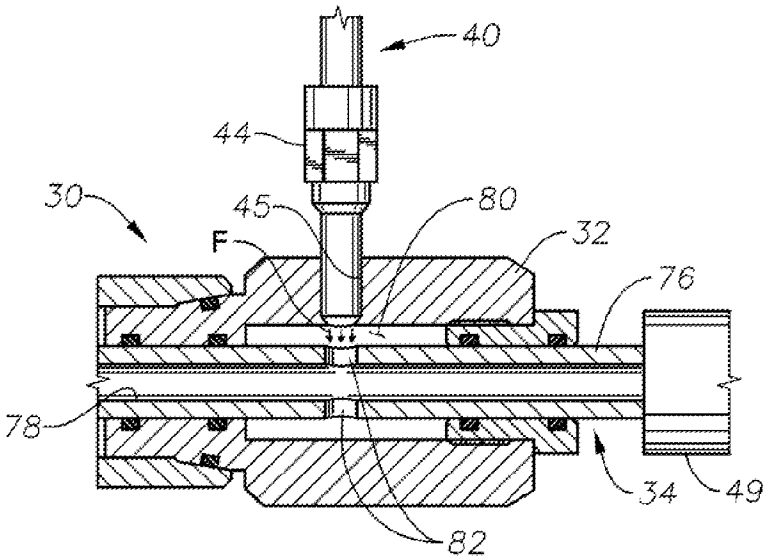
FIG. 4 depicts a portion of the system of FIG. 3 in an enlarged side partial sectional view.

Referring now to FIG. 4, a portion of the annulus entry system 30 is shown in a partial sectional view. FIG. 4 illustrates the plunger assembly 34 can include an annular mandrel 76 illustrated having an end attached to the coupling 49. An axial bore 78 defines an open space within the mandrel 76 that extends therethrough from the coupling 49. An annular plenum 80 is provided between the mandrel 76 and body 32. In the embodiment of FIG. 4, a profile in the body 32 section forms a space between the body 32 inner circumference and the mandrel 76. The space defines a plenum 80 that is disposed proximate where the bore 45 laterally pierces the body 32. Bore inlets 82 pass through the mandrel 76 wall and extend between the plenum 80 and axial bore 78. Accordingly, pressurized fluid illustrated by arrows F can be supplied through the line 40 that exits the fitting 44 into the plenum 80 to flow into the axial bore 78 through the bore inlets 82. As will be discussed below, the pressurized fluid, which can be pneumatic and/or hydraulic fluid, communicates with a telescoping element at the plunger assembly 34 to thereby axially extend the boring element 50.

Figure 5:
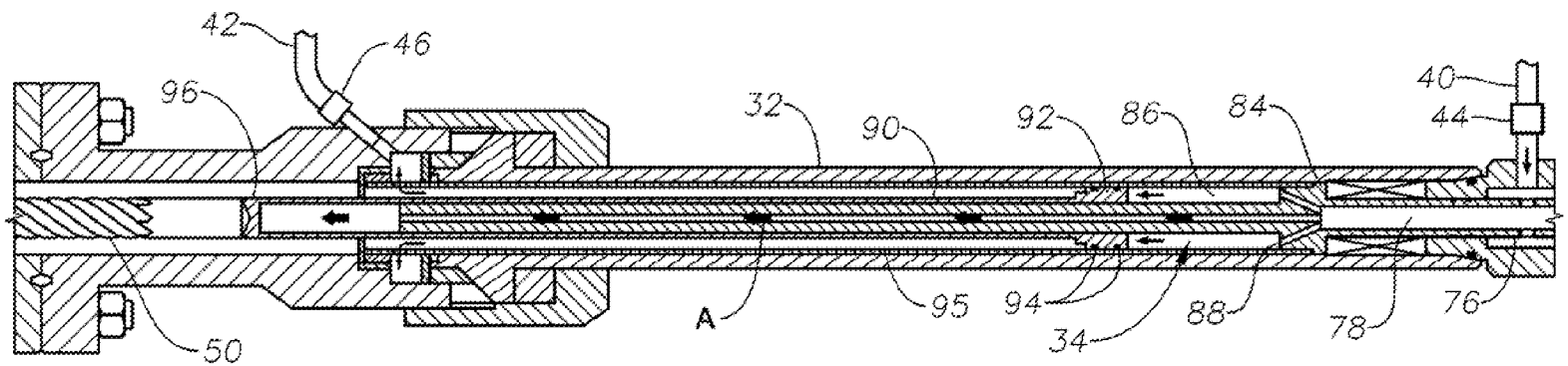
FIG. 5 illustrates a portion of the system of FIG. 3 in an enlarged side partial sectional view.

Referring now to the embodiment of FIG. 5, an expanded view is illustrated of the mandrel 76 and plunger assembly 34. In this example the mandrel 76 outer surface is profiled to form a shoulder 84 that extends out into contact with the housing 32 inner surface. Adjacent the shoulder 84 is an annular space circumscribing the mandrel 76, defining a sleeve annulus 86. Proximate the shoulder 84 are optional oblique channels 88 shown extending between the axial bore 78 and the sleeve annulus 86. Circumscribing a portion of the mandrel 76 is an annular sleeve 90 having an annular piston 92 on its end proximate the shoulder 84. Seals 94 are formed on the piston 92 outer surface, thereby providing a sealing surface between the piston 92 and a lining sleeve 95 provided within the housing inner circumference. The sleeve 90 extends axially past the mandrel 76 end and is slideable along the mandrel 76 outer surface. A solid bulkhead is shown disposed within the sleeve 90 defining a closed end 96 within the sleeve 90. Pressurized fluid that flows through the axial bore 78 is represented by arrows A; that as shown, exits the axial bore 78 and enters the space within the sleeve 90. Pressurized fluid contacts the closed end 96 resulting in a force in the direction of the arrows, thereby urging the sleeve 90 slidingly from the mandrel 76.

Figure 6:
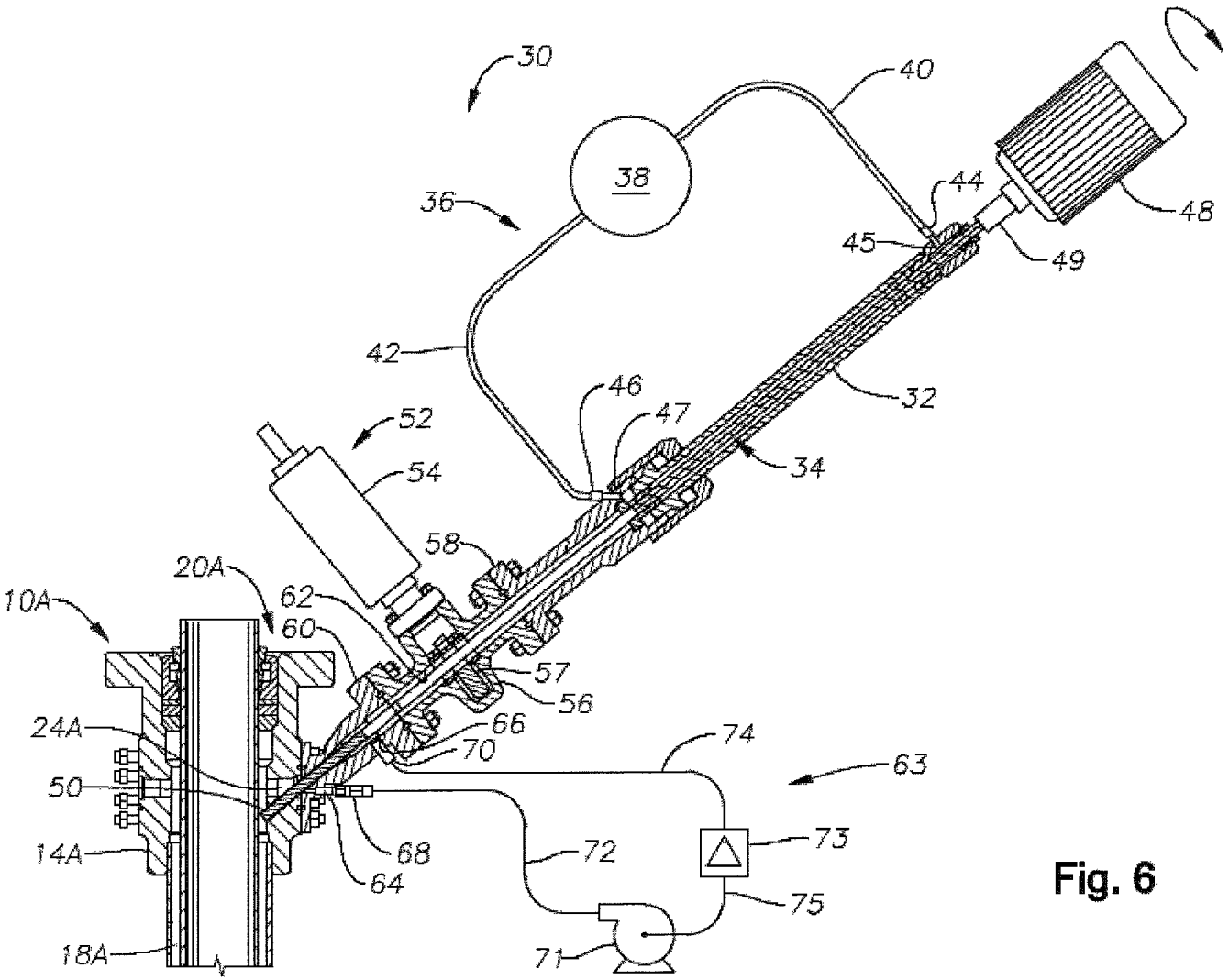
FIG. 6 portrays an example of the system of FIG. 3 accessing a wellhead assembly annulus.
Figure 7:
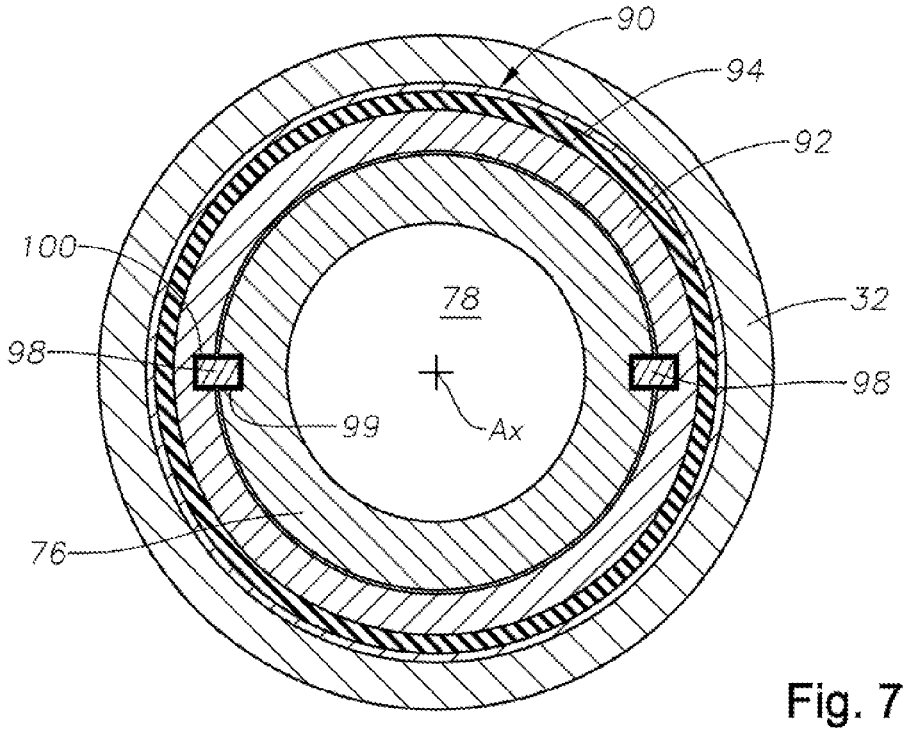
FIG. 7 depicts a portion of the system of FIG. 3 in an axial sectional view.

An example of the boring element 50 contacting the wellhead assembly 10A is illustrated in a side partial sectional view in FIG. 6. In this example, pressurized fluid entering the body 32 and directed to the axial bore 78 has contacted the closed end 96 of the sleeve 90, thereby urging the boring element 50 into boring contact with the wellhead housing 14A. Coupled with this axial movement is rotational movement by the motor 48 to rotate the coupling 49 and mandrel 76. Referring to FIG. 7, an axial sectional view is provided illustrating a rotating coupling between the mandrel 76 and sleeve 90. The sectional view of FIG. 7 illustrates a key 98 that is disposed in a groove 99 formed on the mandrel 76 outer surface and wherein the groove is oriented along the mandrel 76 axis A. Groove 99 registers with a corresponding groove 100 formed along the piston 92 portion of the sleeve 90 inner circumference. As shown, an O-ring type seal 94 can be disposed between the piston 92 outer circumference and housing 32 inner surface. The tolerance of the grooves 99, 100 and key 98 is such that the mandrel 76 and sleeve 90 are free to slide with respect to one another, i.e., telescope, and yet they are rotatingly coupled so that rotation of one will cause rotation of the other. Optionally, in lieu of keys 98, a splined arrangement could be incorporated for the rotational coupling between the mandrel 76 and sleeve 90.

Referring back now to FIG. 6, as the boring element 50 is forming an opening through the wellhead assembly 10A, the optional cleaning fluid circuit 63 may be activated, thereby washing the machined particles away from the cutting surface where they may be collected in the filter 73. This fluid, as noted above, can also provide a cooling function, thereby increasing and enhancing boring efficiency.

Figure 8:
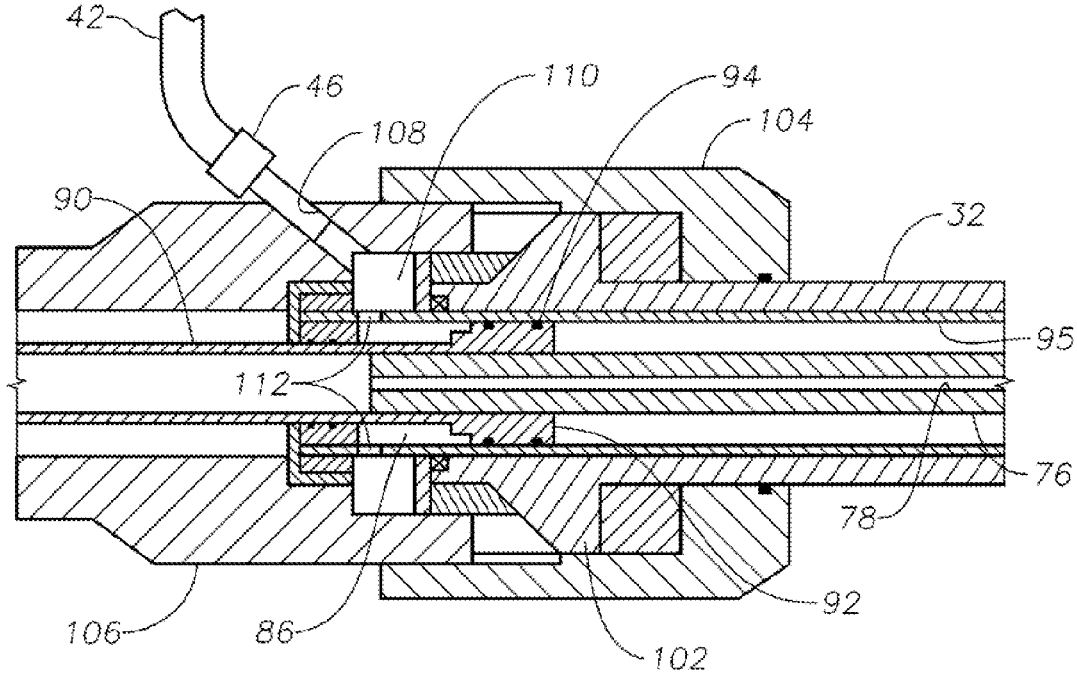
FIG. 8 illustrates a portion of the system of FIG. 3 in an enlarged side partial sectional view.

The plunger assembly 34 can be returned to its retracted mode by reversing the flow direction through the hydraulic circuit 36. An example of retracting the plunger assembly 34 is shown in a side sectional view in FIG. 8. In this example, the body 32 end 102 transitions outward thereby increasing its outer diameter. Circumscribing the body 32 end 102 is an annular collar 104 having an open end oriented towards the valve assembly 52. The collar inner surface is shown threadingly engaged with the body 32 end 102 outer circumference. The end of the collar 104 opposite its open end transitions radially inward into circumscribing contact with the lower diameter portion of the body 32. The collar 104 open end inner surface is threadingly coupled to a connector 106. In the embodiment of FIG. 8, the hydraulic fitting 46 is inserted within a bore 108 that is formed through the connector 106 to its inner circumference. A connector annulus 110 is shown formed within the connector 106 inner circumference and the sleeve 95 outer circumference. Bores 112 extend through the sleeve 95 adjacent the connector annulus 110 and provide fluid communication between the connector annulus 110 and the sleeve annulus 86. Accordingly, pressurized fluid in the line 42 can exit the hydraulic connector 46 to flow through the annulus 110, bores 112, and enter the sleeve annulus 86 to create a pressure differential across the annular piston 92. A resulting force from the pressure differential can urge the piston 92 axially along the mandrel 76 to return the sleeve 90 to its retracted position as depicted in FIG. 3.

Figure 9:
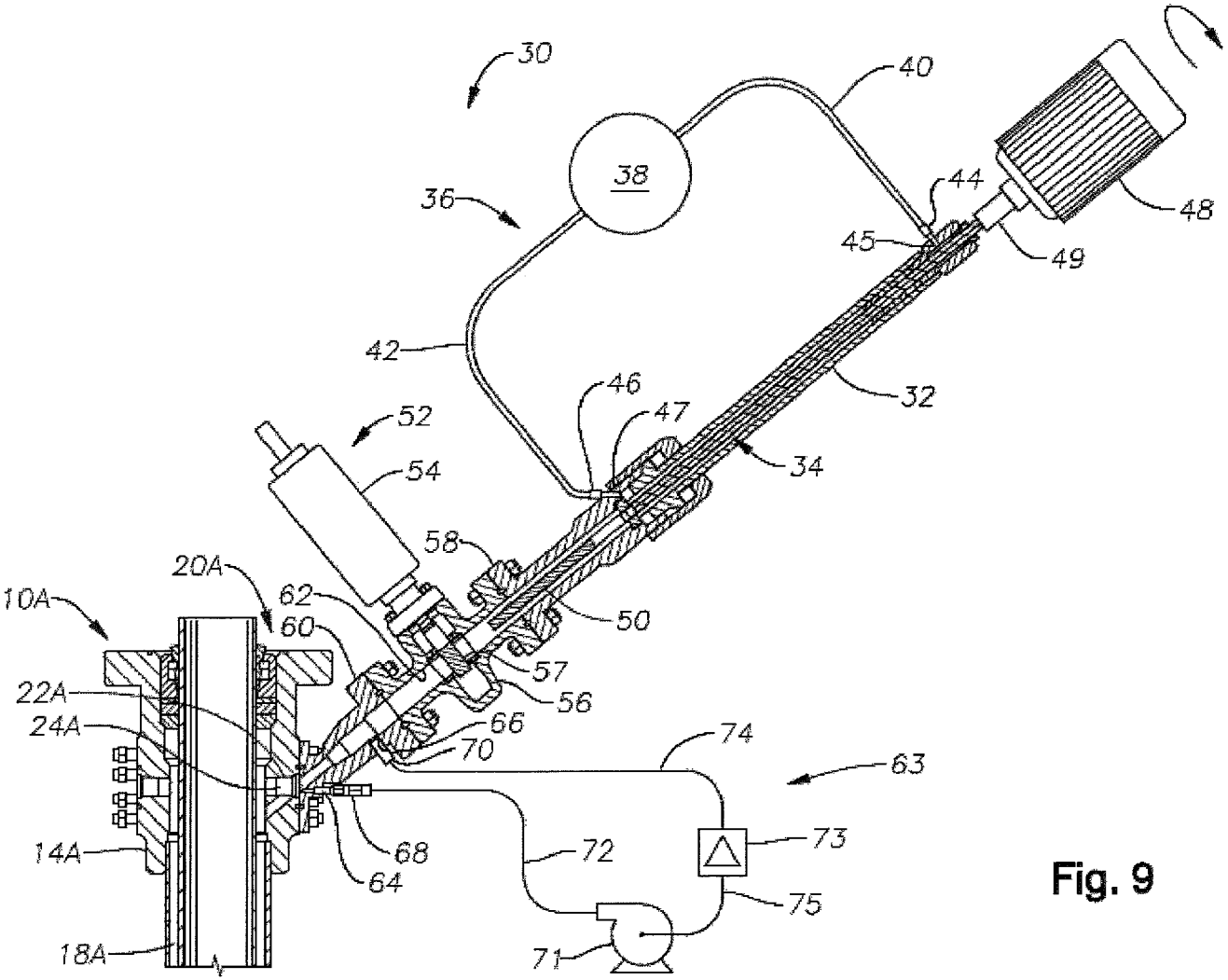
FIG. 9 illustrates the system of FIG. 3 during an operational step.

FIG. 9 illustrates an example of use after the opening is formed through the wellhead assembly 10A. As illustrated, the plunger assembly 32 is being retracted thereby drawing the boring element 50 away from the wellhead assembly 10A and past the valve assembly 52. The valve assembly 52 is shown actuated to move the gate 57 into the passage 62. The gate 57 seals in the passage 62 and forms a pressure barrier between the wellhead annulus 18A and the portion of the housing 32 on the side of the valve assembly 52 opposite the wellhead assembly 10A. The flange 58 can be unbolted from the valve body 56 and the body 32 with attached motor 48 can be removed without venting the annulus to atmosphere.

Figure 10:
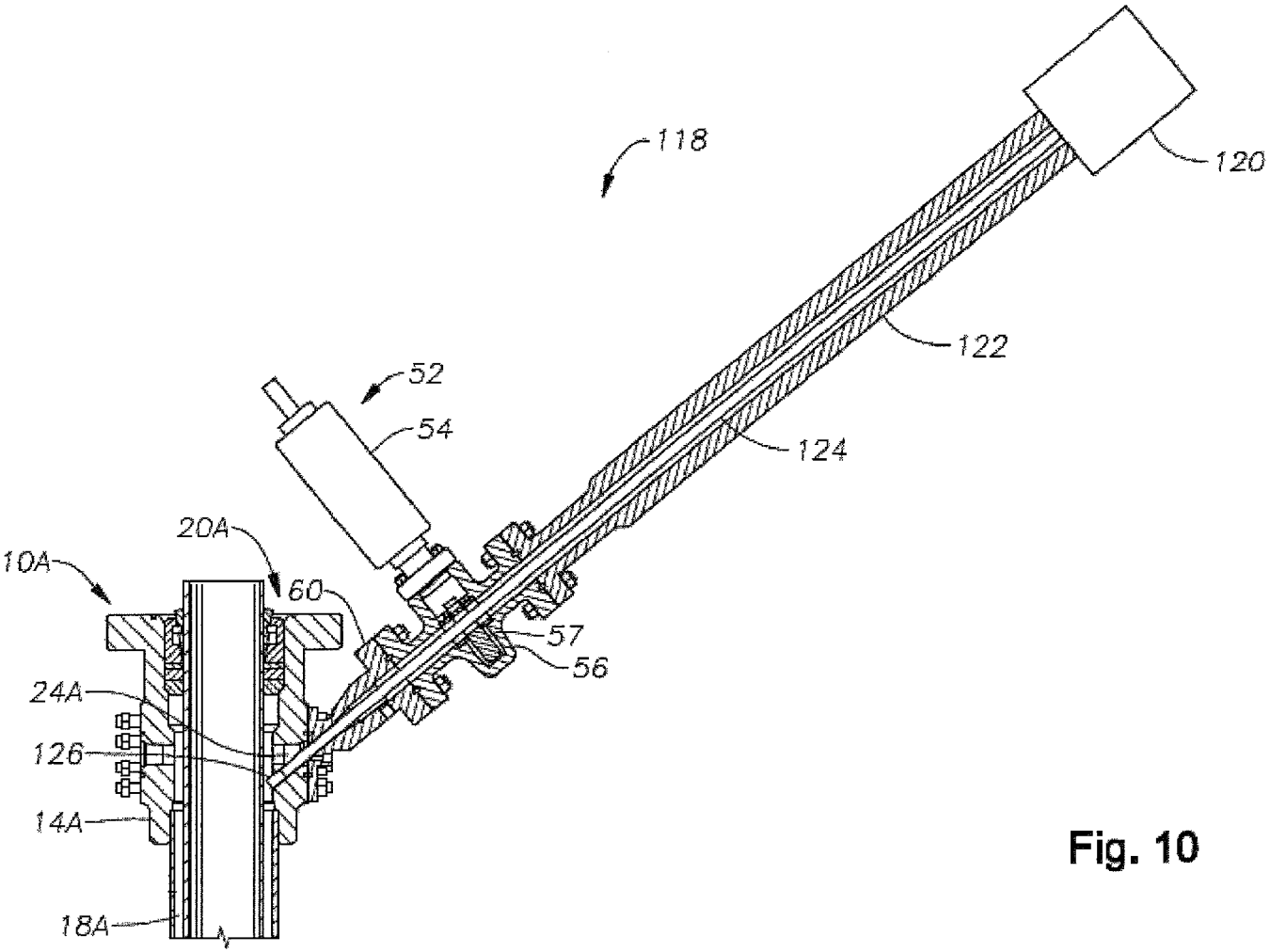
FIG. 10 illustrates an example of an annulus remediation system coupled to a wellhead assembly.
Figure 11:
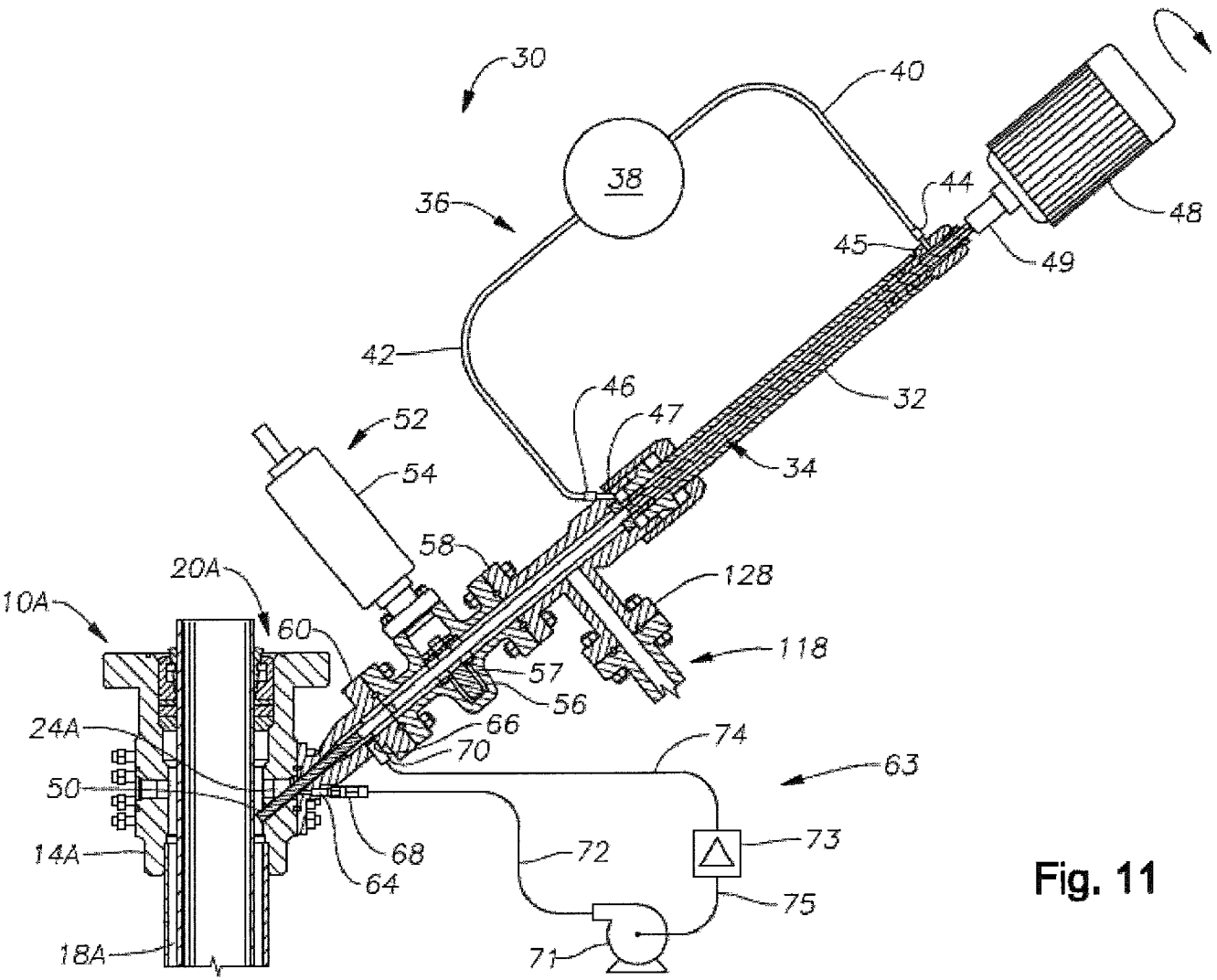
FIG. 11 is an alternative embodiment of the system of FIG. 3.

As shown in FIG. 10, an annulus remediation system 118 can be installed in place of the body 32. In the embodiment of FIG. 10, the annulus radiation system 118 includes a hose deployment/retraction system 120 with an attached annular body 122. A hose 124 is manipulated by the hose deployment/retraction system 120 through the body for insertion and retrieval from the annulus. A nozzle 126 may be included on the hose 124 end for forming a fluid spray from the hose 124. Alternatively, as shown in a side partial sectional view in FIG. 11, a flange 128 may be included with the body 32 on which the annulus remediation system 124 can be attached so that annulus remediation can take place without removing the body 32.

In an example of use of the system 30 described herein, the port 22A communicating with flow line 20A is plugged by inserting the threaded plug 24A therein. A tool (not shown) is coupled with the flow line 20 downstream of the valve 21. The tool includes a shaft that is insertable in the flow line 20 and up to the port 22A. A seal, also insertable into the flow line 20, spans across the space between the shaft and flow line 20 and maintains a pressure barrier in that space as the shaft traverses within the flow line 20. The plug 24A attaches to the free end of the shaft and is inserted into the port 22A by opening the valve 21, urging the shaft past the valve 21 so the plug 24A contacts the port 22A, then rotating the plug 24A to engage threads in the port 22A. Since the plug 24A seals the port 22A, the flange 19 can be unbolted without depressurizing the annulus 18A.

The system 30 (FIG. 3) can be coupled to the wellhead assembly 10A as a single unit or in sections, i.e. adapter 60, cleaning fluid circuit 63, valve assembly 50, body 32 with plunger assembly 34, and motor 48. Alternatively, two or more of the sections can be combined when added to the remaining hardware. In yet another embodiment, one or more of the sections can be replaced and/or omitted from the assembly used. After attaching the system 30 for use, the boring element 50 is urged into contact with the wellhead housing 14A for forming a passage through the housing 14A. Pressurized fluid, such as from the hydraulic circuit 36, may be introduced into the body 32 for telescoping the plunger assembly 34. Optionally, a mechanical drive system, such as rotary or rack and pinion gears, can be used for extending the plunger assembly 34 so the boring element 50 linearly translates into contact with the housing 14A. Rotating the boring element 50 while contacting the wellhead housing 14A (FIG. 6) bores a hole through the housing 14A. Rotary power can be supplied by the motor 48 or by directing pressurized fluid, such as from the hydraulic circuit 36, across a turbine (not shown) coupled to the boring element 50. A mechanical stop (not shown) may be provided with the system 30 to detect the element's 50 lateral movement to determine when it has finished forming the hole. Optionally, monitoring the motor's 48 power usage for a drop in usage can indicate when boring is complete. After forming the passage into the annulus 18A, the boring element is retracted to upstream (low pressure side) of the valve assembly 52. Moving the gate 57 (FIG. 9) into the passage 62 pressure isolates the passage 62 portion having the element 50 from the portion in pressure communication with the annulus 18A. Remediation procedures can now be performed in the annulus 18A (FIGS. 9, 10).

The passage 62 through the adapter 60 is shown at an angle of about 45° with respect to the port 22A. By angling the boring element 50 downward as it forms the hole in the wellhead housing 14A, avoids contact with the wellhead assembly 10A tubing hanger (not shown). However other angles for the passage 62 are included with the scope of the present disclosure, example angles range from about 10° to about 80°, and increments of about 1° in that range.

The present system and method described herein, therefore, is well adapted to carry out and attain the ends and advantages mentioned, as well as others inherent therein. While a presently preferred embodiment has been given for purposes of disclosure, numerous changes exist in the details of procedures for accomplishing the desired results. For example, in an alternative embodiment, the sleeve 90 may be disposed within the axial bore 78 and slidable therein by providing pressurized fluid against one of its ends. These and other similar modifications will readily suggest themselves to those skilled in the art, and are intended to be encompassed within the spirit of the present invention disclosed herein and the scope of the appended claims.

What is claimed is:

1. A method of providing an access path to an annulus in a wellhead assembly comprising:

providing an apparatus comprising, a housing, a selectively extendable and selectively rotatablc plunger assembly that comprises a mandrel, a sliding sleeve circumscribing the mandrel, a plenum between the mandrel and the housing, a fluid fitting radially coupled in the housing in fluid communication with the plenum, an axial bore in the mandrel, and bore inlets formed through the mandrel between the plenum and axial bore, and wherein the pressurized fluid flows from the fluid fitting, through the plenum, bore inlets, and axial bore, and flows into the sleeve from the axial bore, and a boring element on an end of the plunger assembly;

sealingly connecting an end of the housing to an outer surface of the wellhead assembly;

rotating the boring element by rotating the plunger assembly; and boring an opening through the wellhead assembly by extending the plunger assembly in a direction along the housing and rotatingly contacting the wellhead assembly with the boring element to thereby provide pressure communication between the annulus and the housing.

2. The method of claim 1, further comprising retracting the boring element from the wellhead assembly and accessing the annulus through the opening.

3. The method of claim 1, further comprising retracting the boring element from the wellhead assembly, providing a seal between the boring element and the wellhead assembly, replacing the plunger assembly with an annulus remediation system having an elongate flexible member, removing the seal, and inserting an end of the flexible member through the opening and into the annulus.

4. The method of claim 1, wherein the apparatus further comprises a motor having a drive shaft coupled to the plunger assembly, so that operating the motor rotates the plunger assembly.

5. The method of claim 1, wherein the step of extending the plunger assembly in a direction along the housing comprises introducing pressurized fluid into the plunger assembly.

6. The method of claim 1, wherein the apparatus further comprises a passage axially provided in the housing, the method further comprising selectively sealing the passage between the wellhead housing and the mandrel.

7. The method of claim 1, wherein the apparatus includes a sleeve, an annular space between the sleeve and the housing and an annular piston attached to the sleeve outer periphery that extends into sealing contact with the housing inner surface, the method further comprising moving the boring element away from the wellhead assembly by providing pressurized fluid into the annular space on the side of the piston facing the wellhead assembly.

8. The method of claim 1, further comprising directing a fluid flow at the boring element as it rotatingly contacts the wellhead assembly.

9. An apparatus for providing access to an annulus within a wellhead assembly, the apparatus comprising:

a tubular body;

a selectively extendable and selectively rotatable plunger assembly disposed in the body and comprising, a sleeve rotatingly coupled with a mandrel and slidable thereon;

an annular piston circumscribing the sleeve that extends radially outward into sealing contact with an inner circumference of the housing;

a rotating drive source coupled to the plunger assembly;

an open end on the body sealingly connectable to the wellhead assembly;

a boring element on an end of the plunger assembly facing the body open end, so that when the plunger assembly is extended and rotated, the boring element rotatingly contacts and bores a hole in the wellhead assembly; and a supply of pressurized fluid selectively in fluid communication on the side of the piston facing the wellhead assembly, so that when pressurized fluid is introduced to the side of the piston facing the wellhead assembly, the sleeve slides coaxially within the housing away from the wellhead assembly and retracts the boring element from within the opening bored through the wellhead assembly.

10. The apparatus of claim 9, wherein the body is disposed at an oblique angle to a longitudinal axis in the wellhead assembly axis, so that when the boring element bores the hole in the wellhead assembly, the hole is directed downward and inward.

11. The apparatus of claim 9, further comprising a pressurized fluid source in communication with a space in the plunger assembly and a motor coupled to the plunger assembly.

12. The apparatus of claim 9, wherein the hole through the wellhead assembly provides pressure communication between the annulus and the housing.

13. The apparatus of claim 9, further comprising a housing that comprises a tubular end portion circumscribing the plunger assembly, a valve body connected to an end of the end portion, and an annular adapter having a side connected to the side of the valve body opposite the end portion and another side comprising the housing open end and connected to the wellhead assembly.

14. The apparatus of claim 13, further comprising a port formed through the adapter having an inlet in selective fluid communication with a supply of fluid and a discharge directed towards the wellhead assembly, so that when the boring element bores the hole through the wellhead assembly, fluid flow from the discharge can cool the boring element and irrigate away particles of the wellhead assembly machined by the boring element.

15. The apparatus of claim 9, further comprising a plenum within the body and circumscribing a portion of the mandrel, an axial bore formed through the mandrel, a port formed through the body adjacent the plenum, a pressurized fluid source in selective communication with the port, bore inlets in the mandrel extending between the plenum and axial bore, and a closed end on the sleeve in pressure communication with the axial bore, so that when pressurized fluid flows into the axial bore a force is applied to the closed end to urge the sleeve away from the mandrel.

16. The apparatus of claim 15, further comprising a bypass port extending from the axial bore to the mandrel outer surface.

17. The apparatus of claim 9, wherein the sleeve comprises an annular portion with an open end in which the mandrel is slidingly received and a solid portion forming the closed end, wherein the boring element is on the end of the sleeve opposite the open end.

18. A wellhead assembly comprising:

a wellhead housing;

tubulars coaxially depending within the wellhead assembly defining an annulus between the tubulars;

a tubular member having an end sealingly attached to an outer portion of a sidewall of the wellhead housing;

a passage within the tubular member extending along a longitudinal axis;

a selectively rotatable plunger assembly provided within the passage and having a selectively telescoping end;

a boring element on the telescoping end;

a pressurized fluid source in selective communication with the plunger assembly, so that when pressurized fluid is supplied to the plunger assembly, the telescoping end is extended to contact the boring element with the wellhead housing; and a motor having a rotatable drive shaft attached to the plunger assembly, so that when the motor activates the rotatable drive shaft and the boring element contacts the wellhead housing, the rotating boring element machines an opening through the wellhead housing.

19. The wellhead assembly of claim 18, wherein the plunger assembly comprises an annular mandrel having an end coupled to the motor drive shaft, an axial bore in the mandrel in selective communication with pressurized fluid, a sleeve rotationally coupled to the mandrel and slideable with respect to the mandrel along the mandrel axis, and a piston surface on the sleeve defined by a wall substantially perpendicular to the sleeve axis.

20. The wellhead assembly of claim 19, wherein the sleeve is insertable within the axial bore and the piston surface is on the end of the sleeve within the bore.

21. The wellhead assembly of claim 19, wherein the sleeve includes an annular portion that circumscribes the mandrel, and the piston surface comprises a solid portion of the sleeve adjacent the annular portion.

* * * * *